US005537710A

United States Patent [19]

Selewski et al.

[11] Patent Number: 5,537,710

[45] Date of Patent: Jul. 23, 1996

[54] CLEANING TOOL HAVING SPLIT MANIFOLD

[75] Inventors: Steven R. Selewski, Cadillac; John J. Alberts, III, Marion; Anthony T. Alexander, Clarkston; Todd C. Cote, Cadillac; Roy O. Erickson, Jr., Cadillac, all of Mich.

[73] Assignee: Rexair, Inc., Troy, Mich.

[21] Appl. No.: 307,873

[22] Filed: Sep. 16, 1994

Related U.S. Application Data

[63] Continuation-in-part of Ser. No. 146,656, Nov. 2, 1993, abandoned.

[51] Int. Cl.[6] ..... A47L 5/36

[52] U.S. Cl. ..... 15/377; 15/391

[58] Field of Search ..... 15/377, 388, 391, 15/387, 383

[56] References Cited

U.S. PATENT DOCUMENTS

| | | | |
|---|---|---|---|
| 1,026,104 | 5/1912 | Moorhead . | |
| 1,533,368 | 4/1925 | Berg . | |
| 1,606,633 | 11/1926 | Higley . | |
| 1,757,461 | 5/1930 | Losey . | |
| 1,815,067 | 7/1931 | Nulsen et al. . | |
| 1,848,314 | 3/1932 | Butzer . | |
| 1,856,136 | 5/1932 | Orr . | |
| 1,999,667 | 4/1935 | Smellie . | |
| 2,008,476 | 7/1935 | Taylor . | |
| 2,114,099 | 4/1938 | Becker . | |
| 2,283,428 | 5/1942 | Ellis . | |
| 2,296,462 | 9/1942 | Betts . | |
| 2,345,623 | 4/1944 | Oaks . | |
| 2,485,671 | 10/1949 | Sparklin . | |
| 2,528,278 | 10/1950 | Kendrick . | |
| 2,805,440 | 9/1957 | Hakanson . | |
| 2,941,233 | 6/1960 | Prong . | |
| 3,120,021 | 2/1964 | Pauler et al. . | |
| 3,188,681 | 6/1965 | Jepson et al. . | |
| 3,200,433 | 8/1965 | Downey . | |
| 4,190,923 | 3/1980 | Varin | 15/383 |
| 4,333,205 | 6/1982 | Woodward et al. . | |
| 5,003,663 | 4/1991 | Sunagawa et al. | 15/383 X |
| 5,063,634 | 11/1991 | Häfele et al. . | |

*Primary Examiner*—Chris K. Moore

*Attorney, Agent, or Firm*—Jeffrey A. Sadowski; Harness, Dickey & Pierce

[57] ABSTRACT

For a vacuum cleaning unit, a cleaning tool employing a rotatably driven brush and having a split manifold therein which allows a vacuum airflow to be directed to the outermost longitudinal ends of the brush without interference with a drive belt rotatably driving the brush at its approximate longitudinal midpoint. The cleaning tool includes an upper housing having a centrally disposed cut-out portion and a semi-circular portion for partially housing the brush therein. A cut-out is formed in a base portion of the upper housing. A lower housing also has a cut-out shaped identically to that of the cut-out portion of the upper housing. A front sole plate is included which is secured to the lower housing and which includes a pair of openings separated by a central portion, where the openings allow portions of the brush to protrude. Each of the upper and lower housings further have runner portions which form airflow channels through which a vacuum airflow may be generated. When the upper and lower housings are secured together, a drive belt is able to extend through the centrally disposed cut-out portion, the cut-out portion in the base of the upper housing and the cut-out portion in the lower housing to engage at its approximate longitudinal mid-point. The apparatus thus allows a brush to be rotatably driven from its approximate longitudinal mid-point while providing an increased vacuum airflow to the outermost end portions of the brush. In an alternative embodiment, a snappingly engageable front sole plate is provided which allows quick and easy access to the interior of the cleaning tool with the need to remove threaded fasteners or the like, or the need for any external tools.

15 Claims, 8 Drawing Sheets

34
52
10
52
36
26
26a
52
52
40
44
50
26a
32
54
66
28a
28
42
28a
28b
54
66
46
68
63
56
30
58
56
68
64
61
60
61
63
64

CLEANING TOOL HAVING SPLIT MANIFOLD

CROSS-REFERENCE TO RELATED APPLICATION

This application is a continuation-in-part application of U.S. application Ser. No. 08/146,656, filed Nov. 2, 1993, currently abandoned and assigned to the assignee of the present invention.

BACKGROUND OF THE INVENTION

1. Technical Field

This invention relates to cleaning tools and, more particularly, to a cleaning tool having a rotationally driven brush which is adapted to be used in connection with a vacuum generating device such as a vacuum cleaner.

2. Discussion

Vacuum cleaners are used in a variety of applications to clean various work surfaces such as floors, walls, as well as furniture and tables. Vacuum cleaner units often are used with cleaning accessories in the form of attachments which may be quickly and easily removed from a vacuum cleaner hose or wand. Such attachments typically aid one in even more thoroughly cleaning a surface than would otherwise be possible with just the vacuum force provided by a vacuum unit.

One type of cleaning tool attachment which is used extensively with vacuum cleaner units is that employing a brush unit. The brush may be driven by a motor to help loosen dirt and other debris from carpeted surfaces or other cloth covered surfaces such as that which might be encountered on furniture.

With the above described cleaning tool attachment it is important that some means be provided by which the brush can be driven rotationally by the motor and that a vacuum airflow may be generated through the areas of the cleaning tool closely adjacent the brush to pick up dirt and debris loosened by the brush from a surface. It is important that the cleaning tool attachment not only is designed to maximize the vacuum force which may be developed in the areas closely adjacent the brush, but also that the brush be driven positively and with a minimum amount of interruption to the vacuum airflow surrounding the brush. It would be even further desirable if the brush could be driven at its approximate longitudinal mid-point rather than at one of its ends as is more typically employed. While the latter form of driving arrangement has worked well, even better edge cleaning capability could be afforded by locating the driving element on the brush at its approximate longitudinal midpoint, which enables the tufts of the brush, and especially its outermost ends, to extend completely to both outermost ends of the brush.

Accordingly, it is a principal object of the present invention to provide a cleaning tool which may be quickly and easily attached and removed from a vacuum cleaner hose or wand attachment, and which includes a brush which is even more positively driven than heretofore developed cleaning tools having rotatably driven brushes.

It is yet another object of the present invention to provide a cleaning tool having a brush which is rotatably driven by a motor of the cleaning tool, and where the brush is driven from an approximate longitudinal mid-point by a driving implement rather than at one of its outermost longitudinal ends.

It is yet another object of the present invention to provide a cleaning tool which includes an airflow directing manifold assembly which allows a brush to be driven rotationally from its approximate longitudinal midpoint, and where the manifold operates to even more effectively direct a vacuum airflow to areas closely adjacent the brush, and especially its outermost ends, to aid in picking up dirt and debris loosened by the brush from a work surface.

It is yet another object of the present invention to provide a cleaning tool which includes an easily, snappingly removable member which may be moved quickly and easily by an operator to allow access to a drive belt of the cleaning tool to replace the drive belt when needed.

It is still another object of the present invention to provide a cleaning tool which includes a member for releasibly engaging with a pivot exhaust tube of the cleaning tool to hold the exhaust tube in an upright position when the cleaning tool is being stored.

It is still another object of the present invention to provide a cleaning tool in which a brush stiffener is incorporated in a brush roll of the cleaning tool to help provided added stiffness to the brushes secured to the brush roll, to thus even further improve the cleaning efficiency of the tool.

SUMMARY OF THE INVENTION

The above and other objects are provided by an apparatus in the form of a cleaning tool having a split manifold in accordance with preferred embodiments of the present invention. In a first preferred embodiment, the apparatus generally includes an upper housing having a base portion, a semi-circular portion adapted to rotatably support a cylindrical brush, and upper runner portions for directing a vacuum airflow. The semi-circular portion includes a centrally disposed cut-out portion adapted to allow a driving implement such as a belt to be coupled to an approximate longitudinal midpoint of the brush to rotatably drive the brush. Further included is a lower housing having lower runner portions. The lower housing is adapted to be coupled to the upper housing to form an airflow directing manifold for directing a vacuum airflow through the semi-circular portion of the upper housing. A sole plate is included which includes a plurality of openings for allowing portions of the brush to protrude into contact with a work surface. The sole plate helps prevent dirt and debris from entering the interior area of the apparatus through other than the manifold.

In the first preferred embodiment the upper housing and lower housing each include symmetrically shaped cut-out portions which further enable a belt or other like implement to engage an approximate longitudinal midpoint of the brush to drive the brush rotationally. The upper and lower housings include portions which cooperate to support a neck portion to allow a vacuum house or wand or other like implement attached to the neck portion to be moved pivotally relative to the apparatus to further enhance the ease with which the apparatus may be used to clean work surfaces.

The preferred embodiment of the present invention thus provides a means by which a vacuum airflow can be directed in close proximity to a rotatably driven brush to make maximum use of the vacuum airflow while the brush is driven from its longitudinal midpoint rather than one of its ends.

In an alternative preferred embodiment of the present invention a cleaning tool is provided having a user removable sole plate which during operation covers an undersurface of the cleaning tool which may be quickly and easily removed by the operator. The front sole plate is further snappingly engaged and releasibly held to an internal manifold of the cleaning tool to allow its removable without the need for a screwdriver, nut driver or any other external tool.

In the alternative preferred embodiment, the cleaning tool of the present invention includes a member for releasibly engaging a pivot exhaust tube of the cleaning tool to releasibly hold the pivot exhaust tube in an upright position during storage. A clear window member is also included to allow the user to quickly and easily determine if a drive belt of the cleaning tool needs replacing. In this manner, no disassembly of the cleaning tool is required simply to make a preliminary determination that the drive belt of the cleaning tool appears to need replacing.

In the alternative preferred embodiment of the present invention, the cleaning tool includes a brushroll having a pair of brush stiffener members within which are mounted the brushes of the brushroll. The brush stiffener members help to provide added rigidity to the brushes to even further enhance the cleaning efficiency of the cleaning tool as the brushroll is driven rotationally by a drive belt of the cleaning tool.

BRIEF DESCRIPTION OF THE DRAWINGS

The various advantages of the present invention will become apparent to one skilled in the art by reading the following specification and subjoined claims and by referencing the following drawings in which:

FIG. 8 is a cross-sectional view of the cleaning tool of FIG. 6 in accordance with section line 8—8;

DETAILED DESCRIPTION OF THE PREFERRED EMBODIMENT

Figure 1:
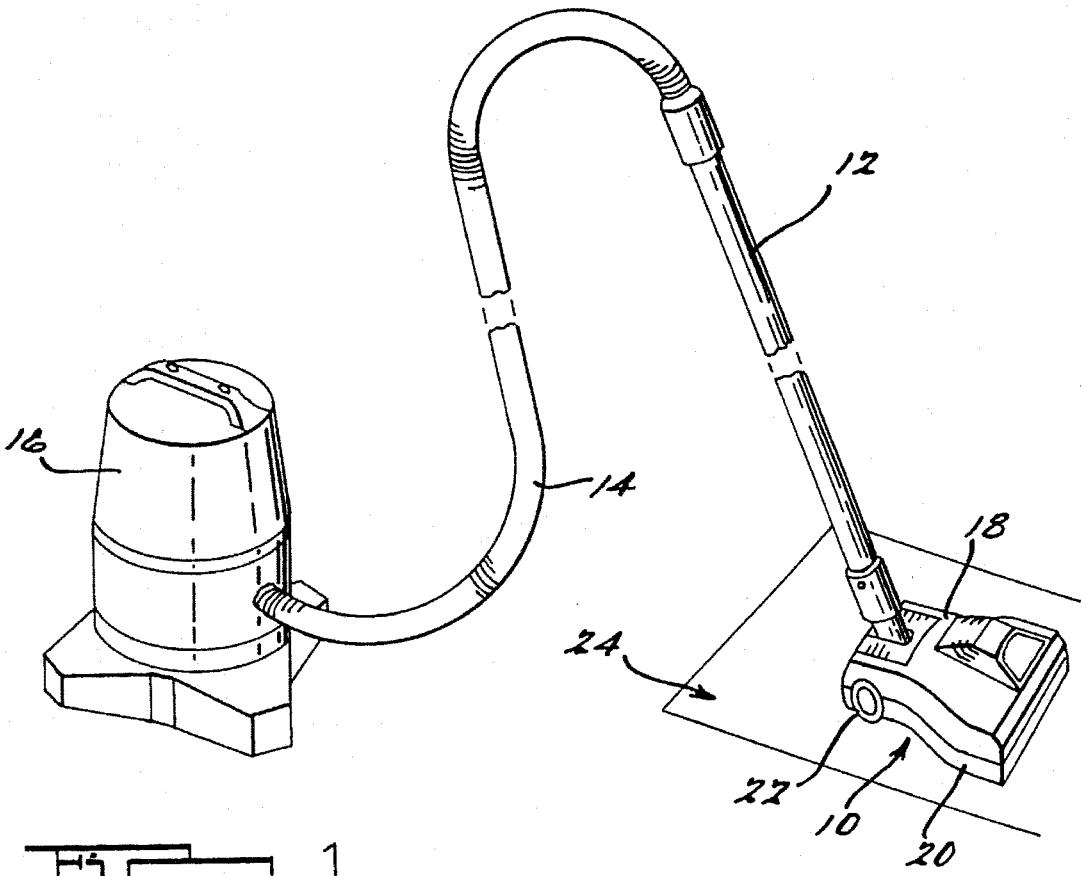
FIG. 1 is a perspective view of a cleaning tool in accordance with the preferred embodiment of the present invention coupled via an extension wand and flexible vacuum hose to a main vacuum unit.

Referring to FIG. 1, there is shown a cleaning tool apparatus 10 in accordance with a preferred embodiment of the present invention. The apparatus 10 is shown removably coupled via an extension wand 12 and a flexible vacuum hose 14 to a main vacuum unit 16. The main vacuum unit 16 generates a vacuum airflow through the apparatus 10, wand 12 and vacuum hose 14 to help dirt and debris to be removed from a work surface such as a carpet, the upholstery of a piece of furniture, floor, etc. The apparatus 10 typically includes an upper cover member 18 and a lower cover member 20 which are secured together to form a single piece unit. At least one wheel 22 is provided for enabling the apparatus 10 to moved more easily above a work surface such as a carpeted floor, designated generally by reference numeral 24.

Figure 2:
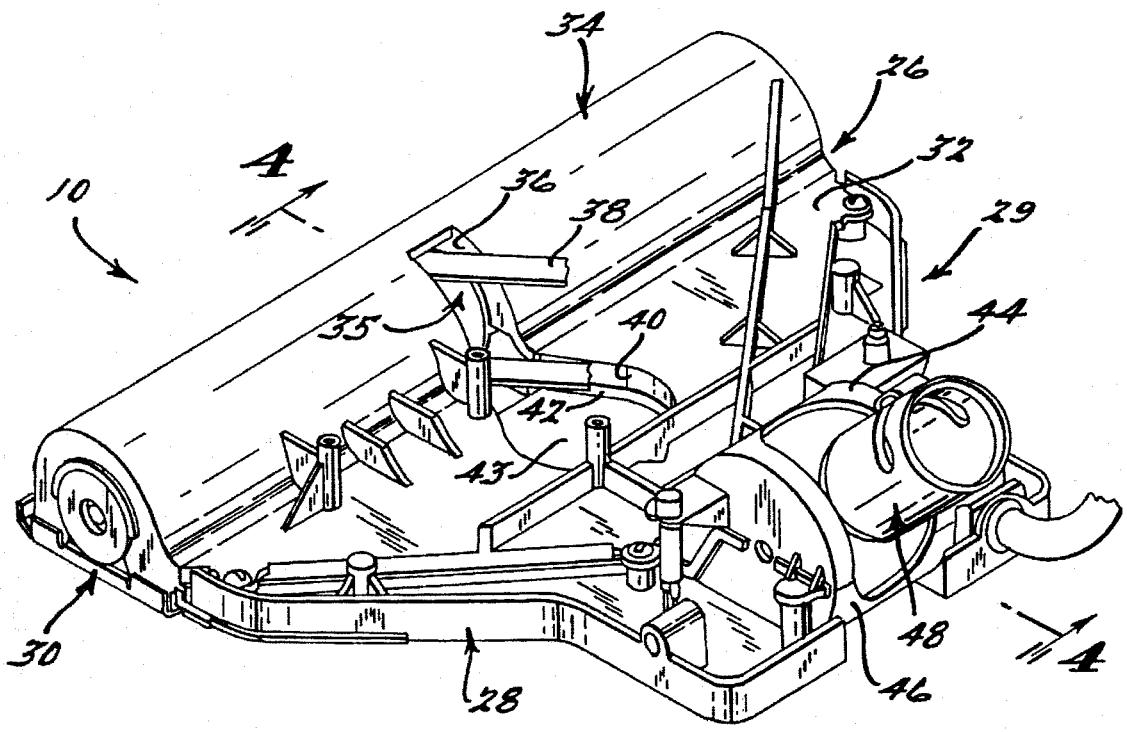
FIG. 2 is a perspective view of the cleaning tool of FIG. 1 with its upper and lower cover members removed to more fully illustrate the split airflow directing manifold.

Referring to FIG. 2, the cleaning apparatus 10 is shown with the upper and lower cover members 18 and 20, respectively, removed, illustrating the internal components of the apparatus 10. The apparatus 10 generally includes an upper manifold housing 26, a lower manifold housing 28 and a front sole plate 30. The upper manifold housing 26 and lower manifold housing 28 together form a "split manifold" 29. The upper housing 26 includes a base portion 32 and a semi-circular portion 34. The semi-circular portion 34 is adapted to partially house a brush 35 therein. The semi-circular portion 34 further includes a centrally disposed cut-out portion 36 which enables a drive belt 38 to be coupled to an approximate longitudinal midpoint of the brush 35 to rotatably drive the brush 35. The base portion 32 further includes a pair of upper runners **26*a* formed therein (also visible in FIG. 4) which help to direct the vacuum airflow generated by the main vacuum unit 16 through the apparatus 10 and closely adjacent the brush 35. A cut-out portion 40 is also included for enabling the drive belt 38 to operate (i.e., move freely) without interference from the upper housing 26**.

The lower housing 28 includes a cut-out portion 42. The cut-out portions 40 and 42 are shaped symmetrically such that they form a single opening 43 which allows the drive belt 38 to extend around the brush without interfering with any portion of the upper housing 26 or the lower housing 28.

With further reference to FIG. 2, the upper housing 26 includes a shoulder portion 44 while the lower housing 28 includes a shoulder portion 46. The shoulder portions 44 and 46 cooperate to captively maintain a neck member 48 to the apparatus 10 in a manner that allows the neck member 48 to move pivotally relative to the apparatus 10. This further enhances the ease with which the apparatus 10 may be moved over a work surface.

Figure 3:
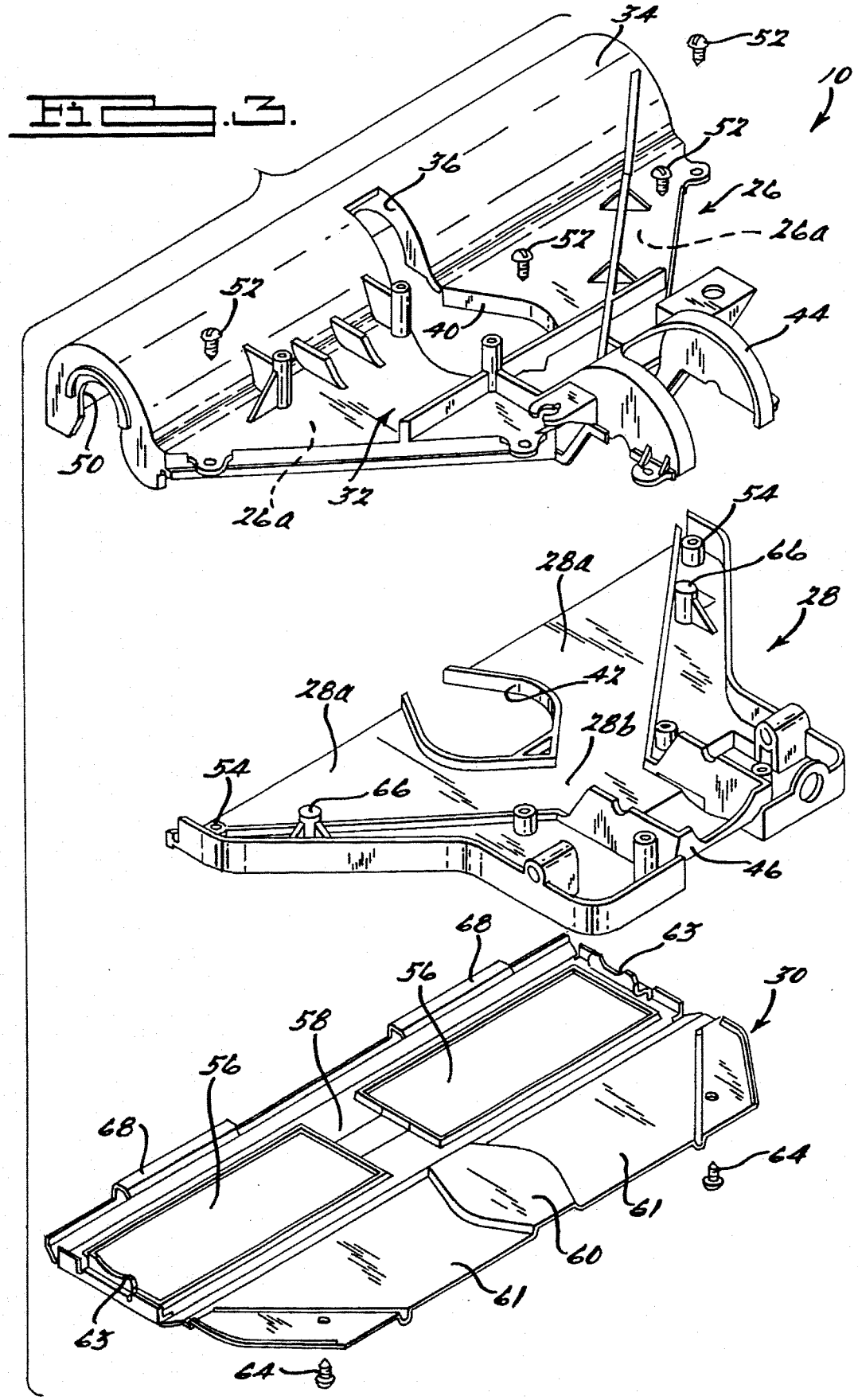
FIG. 3 is an exploded perspective view of the split manifold of FIG. 2.

Referring now to FIG. 3, the upper housing 26 includes a semi-circular cut-out portion 50 at each of its longitudinally outermost ends which allow the brush to be mounted for rotational movement therein. The lower housing 28 includes runner portions **28*a* which converges to a common area 28*b*. The lower housing 28 is secured to the upper housing 26 by threaded screws 52 which engage threaded boss portions 54**.

With further reference to FIG. 3, the front sole plate 30 is shown in more detail. Sole plate 30 includes a pair of openings 56 which are separated by a central portion 58, and a raised sealing portion 60 flanked by panel portions 61. The raised sealing portion 60 is adapted to fit partially within the cut-out portion 42 in the lower housing 28 when the front sole plate 30 is secured to the lower housing 28, to thereby provide a seal to prevent dirt, debris and foreign objects from entering the interior area of the apparatus 10. The front sole plate 30 is secured to the lower housing 28 by threaded screws 64 which engage within threaded bosses 66. Semi-circular shoulder portions 63 help support the outermost ends of the brush 35 for rotational movement.

Figure 4:
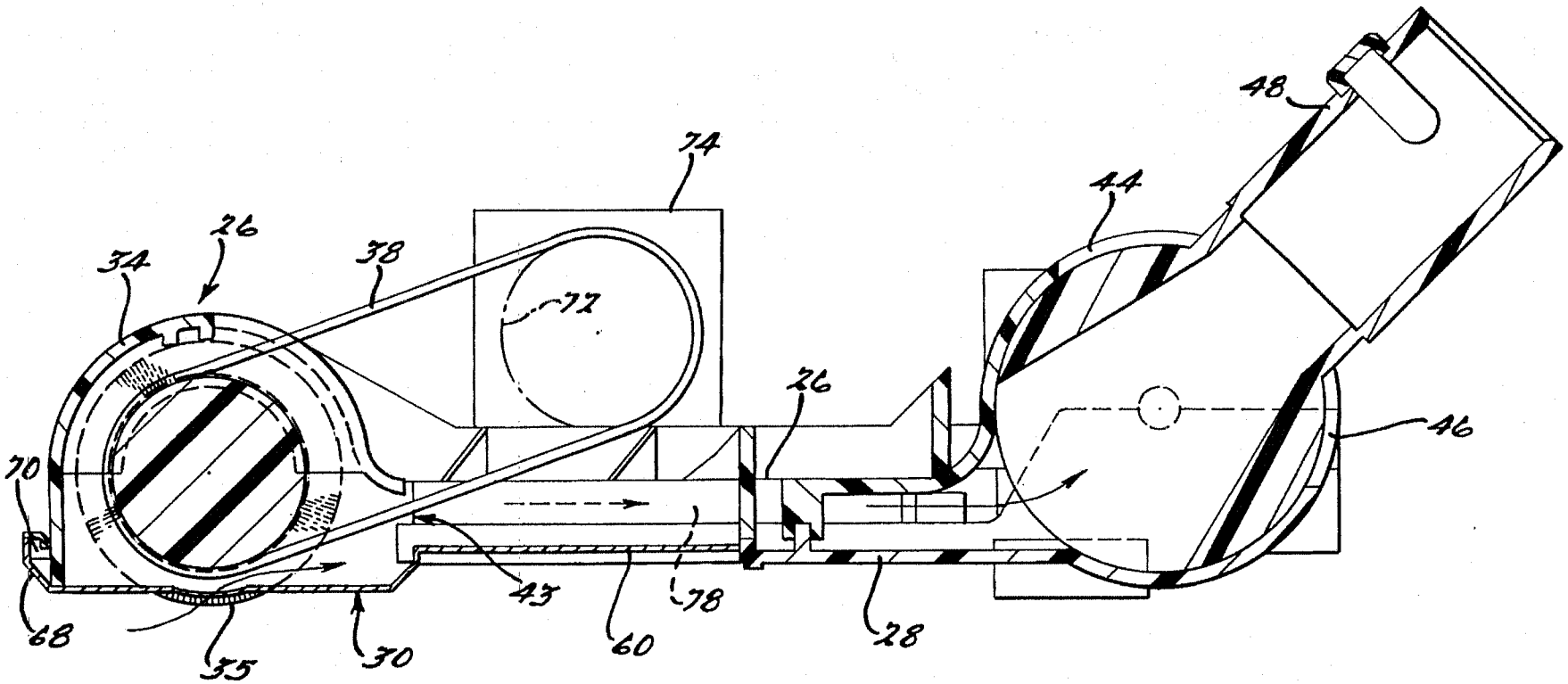
FIG. 4 is a side sectional view in accordance with section line 4—4 of FIG. 2 showing how the drive belt extends through the centrally disposed cut-out portion in the upper housing and the cut-out portion in the base portion of the upper housing to rotationally drive the brush.

With reference to FIGS. 3 and 4, the front sole plate 30 further includes a pair of lip portions 68 (only one of which is visible in FIG. 4) which engage shoulder portions 70 protruding from the semi-circular portion 34 of the upper housing 26 to thus help secure the upper housing 26 to the front sole plate 30. In FIG. 4 the brush 35 of the apparatus is shown mounted for rotational movement within the semi-circular portion 34 of the upper housing 26. The drive belt 38 is coupled to an output shaft 72 of a motor 74 mounted on the upper housing 26. The centrally disposed cut-out portion 36 and the opening 43 formed by the cut-outs 40 and 42 in the upper and lower housings 26 and 28, respectively, allow the drive belt 38 to extend into the semi-circular portion 34 and around an approximate longitudinal midpoint of the brush 35.

From FIG. 4 it can also be seen that the runners **28*a* in the lower housing 28 and the runners 26*a* formed in the base portion 32 of the upper housing 26 form passages 78 (only one of which is indicated in FIG. 4) on either side of the opening 43 (FIGS. 2 and 3) which allow air from the main vacuum unit 16 to be drawn up through the openings 56 in the front sole plate 30, through the passages formed by the runners 26*a* and 28*a*, and through the shoulder portions 44 and 46, and through the pivotally retained neck member 48 back to the main vacuum unit 16. Thus, an efficient means of creating a vacuum airflow in the areas adjacent the brush 35 is provided by the apparatus 10 while still driving the brush 56 from its approximate longitudinal center via the drive belt 38. By driving the brush 72 from its approximate longitudinal center point, the edge cleaning ability of the apparatus 10 is increased. Therefore, the apparatus 10 is even more effective at cleaning close to walls and other furniture where other cleaning tools might have difficulty generating sufficient vacuum airflow to the outermost longitudinal edges of the brush, and therefore have difficulty in effectively picking up dirt and debris loosened by the brush 72 near its outermost end points. Accordingly, the apparatus 10 forms a means by which a brush can be rotatably driven without interfering with a vacuum airflow around the outermost longitudinal ends of the brush. This allows the apparatus 10** to even more effectively pick up dirt and debris loosened by the brush at its outermost longitudinal ends.

Figure 5:
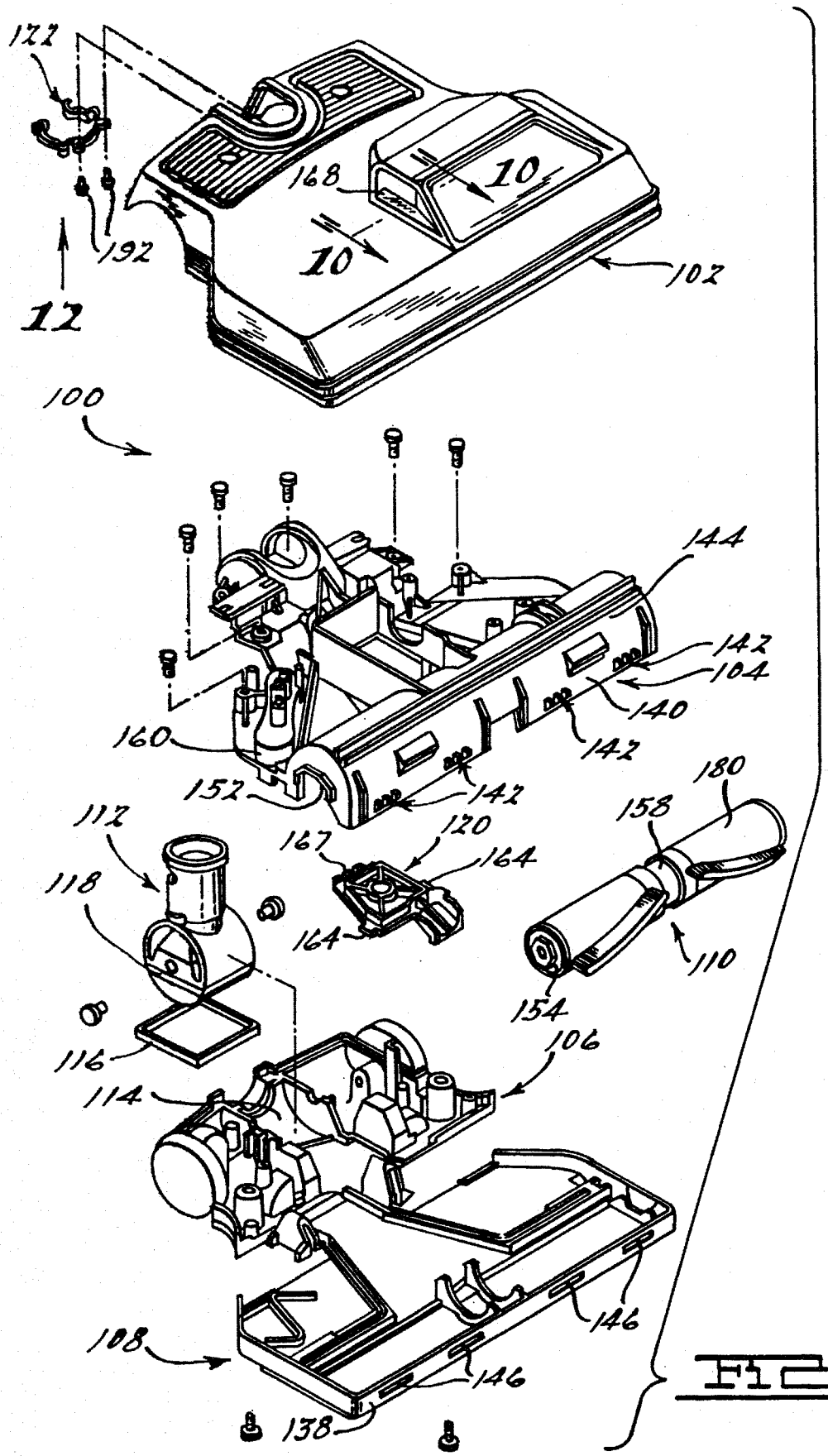
FIG. 5 is an exploded perspective view of a cleaning tool in accordance with an alternative preferred embodiment of the present invention.

Referring now to FIG. 5, a cleaning tool 100 in accordance with an alternative preferred embodiment of the present invention is shown. The cleaning tool 100 includes a cover 102, an upper manifold 104, a rear sole plate 106, a front sole plate 108 and a brushroll 110. A pivotally mounted exhaust tube 112 is mounted within a recess 114 of the rear sole plate 106 to allow a vacuum airflow to be drawn through the cleaning tool 100 when assembled and out through the exhaust tube 112 to an external wand (not shown) attached to the exhaust tube 112 or a flexible vacuum hose (not shown) attached to the exhaust tube 112. A gasket 116 is adapted to fit onto the exhaust tube 112 within a peripheral slot 118 formed about the exhaust tube 112 to provide a sealing effect when the exhaust tube 112 is secured between the upper manifold 104 and the rear sole plate 106, to thereby prevent cleaning airflow from being drawn through this area, rather than through the upper manifold 104 as intended.

With further reference to FIG. 5, a belt cover 120 is releasably secured to an undersurface of the upper manifold 104, as will be described in greater detail momentarily. A retaining member 122 is also included for maintaining the exhaust tube 112 in an upright position during storage of the cleaning tool 100. The retaining member 122 is secured to an undersurface of the cover 102, which will also be described in greater detail momentarily in connection with FIG. 12.

Figure 6:
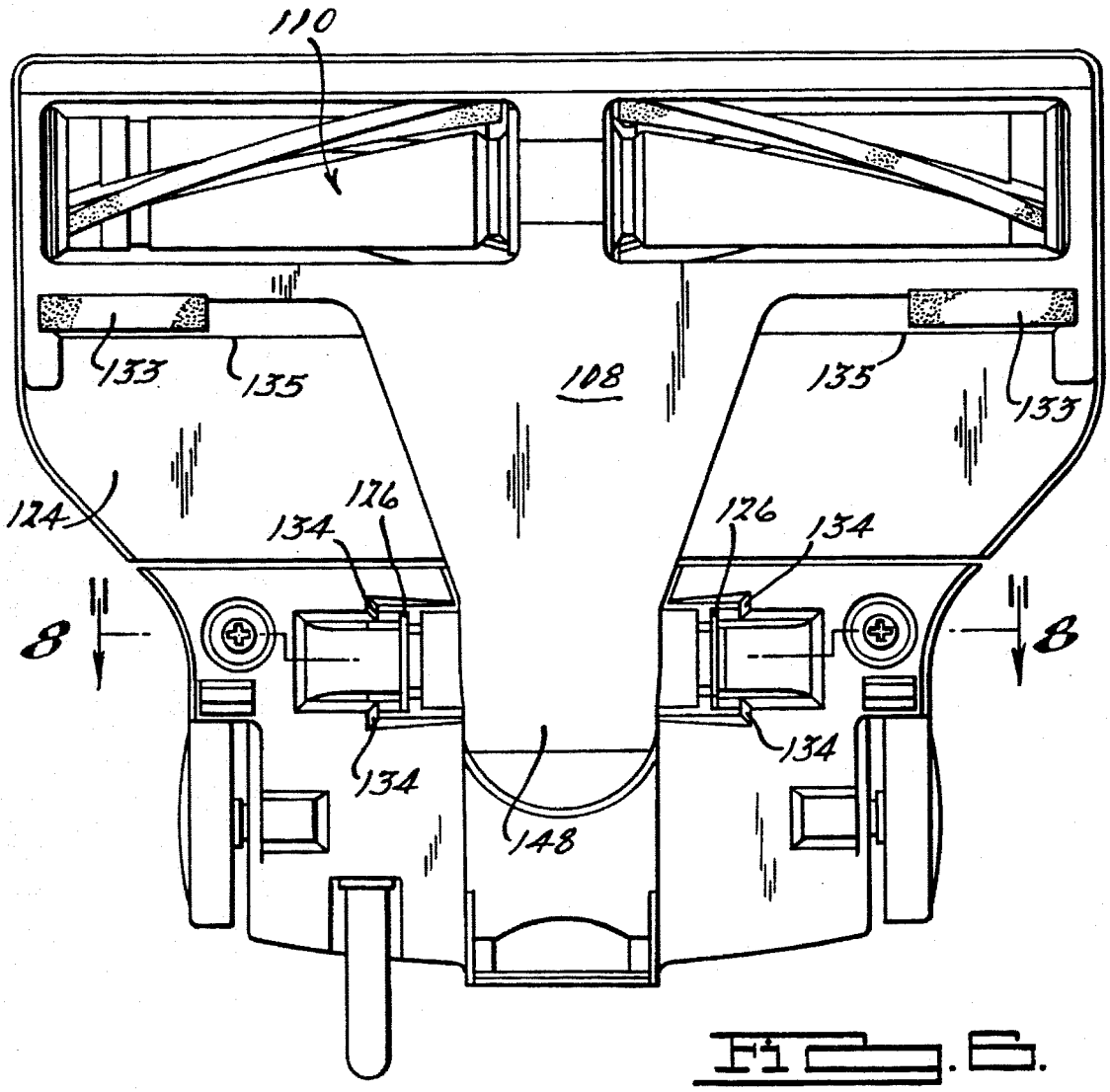
FIG. 6 is a bottom view of the assembled cleaning tool of FIG. 5.

Referring now to FIG. 6, an undersurface 124 of the front sole plate 108 is shown. The front sole plate 108 includes a pair of latching arms 126 which are integrally formed with the front sole plate 108. The latching arms 126 releasably, latchably engage with portions of the rear sole plate 106 to thus hold the front sole plate 108 releasibly to the rear sole plate 106. Accordingly, the need for threaded fasteners such as screws or any other additional component parts is not required. It will be appreciated that this represents a significant enhancement in that the front sole plate 108 can be quickly and easily removed from the rear sole plate 106, and thus from the cleaning tool 100, without the need for any external tools.

With reference now to FIGS. 6 and 8, the inner connection of the front sole plate 108 and rear sole plate 106 is illustrated. The rear sole plate 106 includes a pair of recesses 128 integrally formed therewith which allow U-shaped portions 130 of the latching arms 126 to protrude therein. Each latching arm 126 includes two tabs 132 which are adapted to abuttingly engage associated openings 134 formed in the rear sole plate 106. To remove the front sole plate 108 from the rear sole plate 106 the user merely squeezes the latching arm members 126 towards each other by placing a forefinger and a thumb of one hand on wall portions 136 of the latching arms 126. While urging the latching arms 126 towards each other, the front sole plate 108 may then be lifted away from the rear sole plate 106.

With further reference to FIG. 6, secured to the front sole plate 108 are a pair of edge grooming brush strips 133. The brush strips 133 each consist of a strip of bristles which help to groom a carpet, rug, etc., at the outermost edges of the width of the cleaning tool 100. The brush strips 133 may be secured via a conventional rigid mounting pin (not shown) which securely holds the brush strips 133 securely within slots formed at areas 135 of the front sole plate 108.

Figure 11:
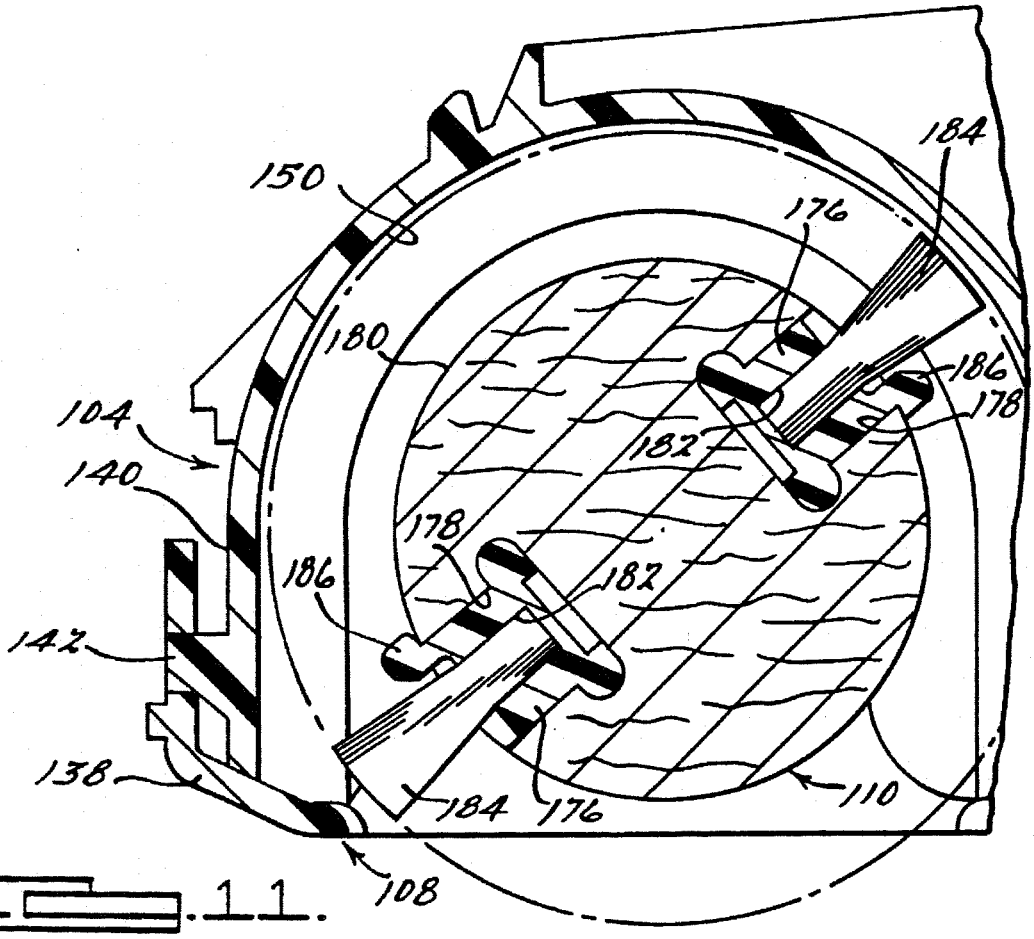
FIG. 11 is a fragmentary, cross-sectional of a front portion of the cleaning tool of FIG. 7 in accordance with section line 11—11 in FIG. 7 showing the interlocking of the front edge portion of the front sole plate with a front edge portion of the manifold of the cleaning tool.

With brief reference now to FIG. 11, the inter-engagement of a front edge portion 138 of the front sole plate 108 with a front edge portion 140 of the upper manifold 104 is shown. The upper manifold 104 includes a plurality of groups of tabs 142, as shown particularly well in FIG. 1, which protrude outwardly from a semi-circular portion 144 of the upper manifold 104. The front sole plate 108 incudes a plurality of spaced apart, longitudinally aligned slots 146 which correspond in longitudinal position to the groups of tabs 142 on the upper manifold 104.

With further reference to FIGS. 5 and 11, when coupling the front sole plate 108 to the cleaning tool 100, the openings 146 are positioned over the groups of tabs 142 such that the front edge portion 138 of the front sole plate 108 is abuttingly disposed against the front edge portion 140 of the upper manifold 104, and such that the groups of tabs 142 protrude through the slots 146 to hold the front edge portion 138 of the front sole plate 108 to the upper manifold 104 and to prevent relative movement between these two components.

Figure 7:
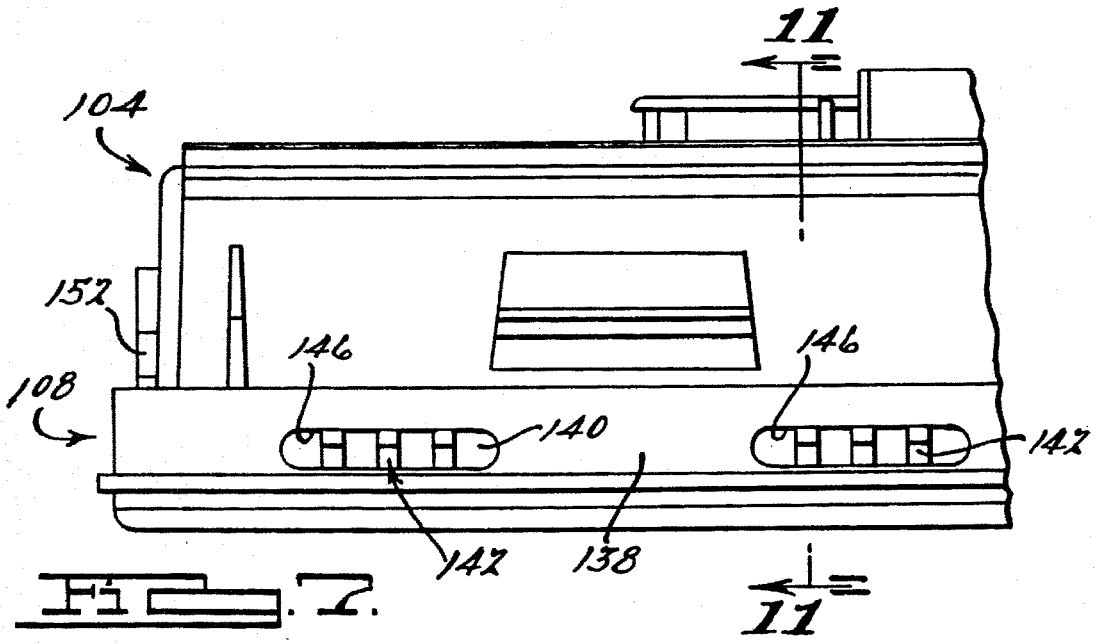
FIG. 7 is a fragmentary front view of the cleaning tool of FIG. 5 with the cover of the cleaning tool removed.
Figure 5:
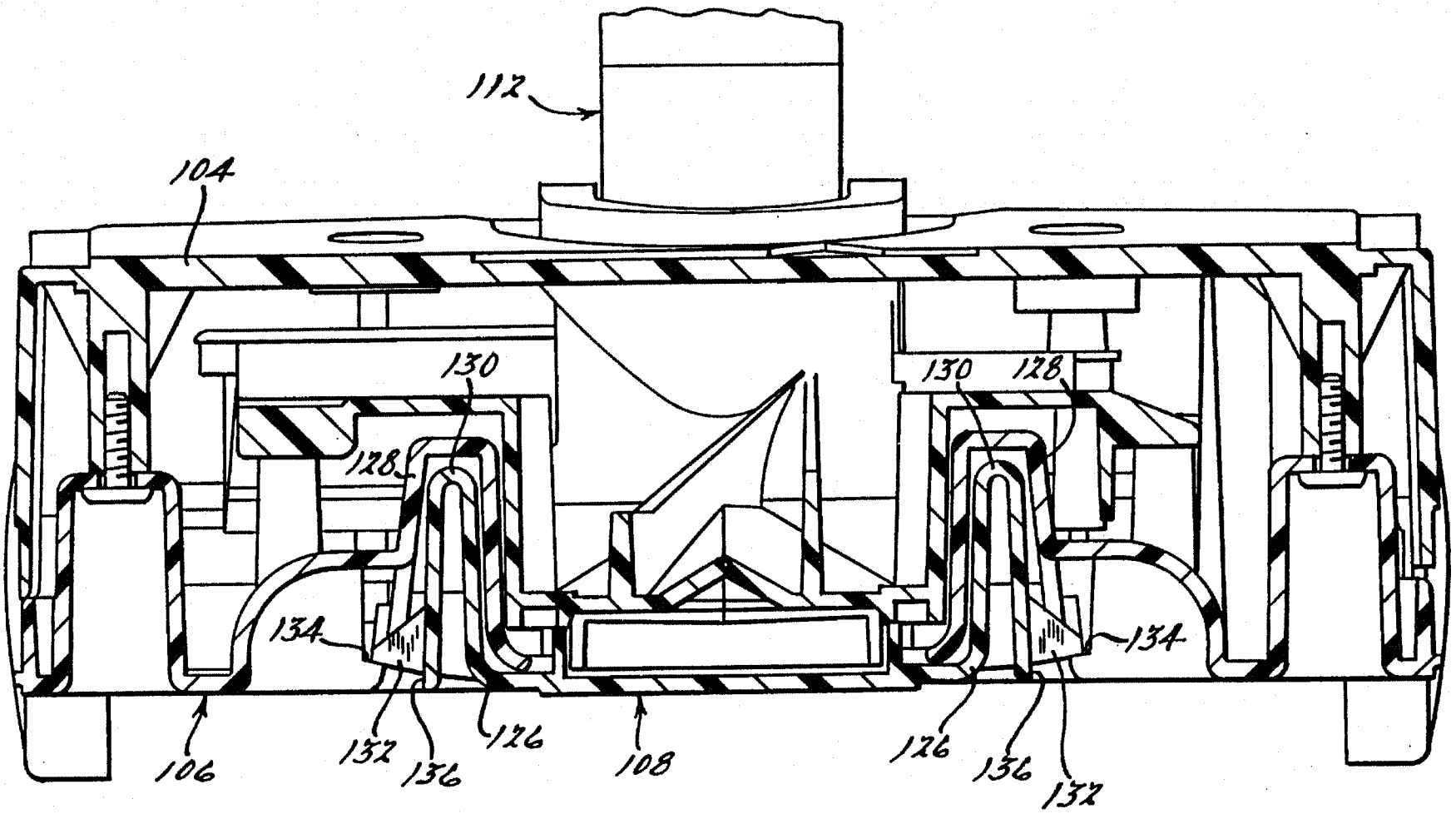

Once the front edge portion 138 of the front sole plate 108 is positioned against the front edge portion 140 of the upper manifold 104, the user may push down on a rear central portion 148 of the front sole plate 108 to cause the latching arm members 126 to engage the openings 134. The interengagement of the front edge portion 138 of the front sole plate 108 with the groups of tabs 142 is shown in FIG. 7 after the front sole plate 108 has been secured to the upper manifold 104.

Figure 9:
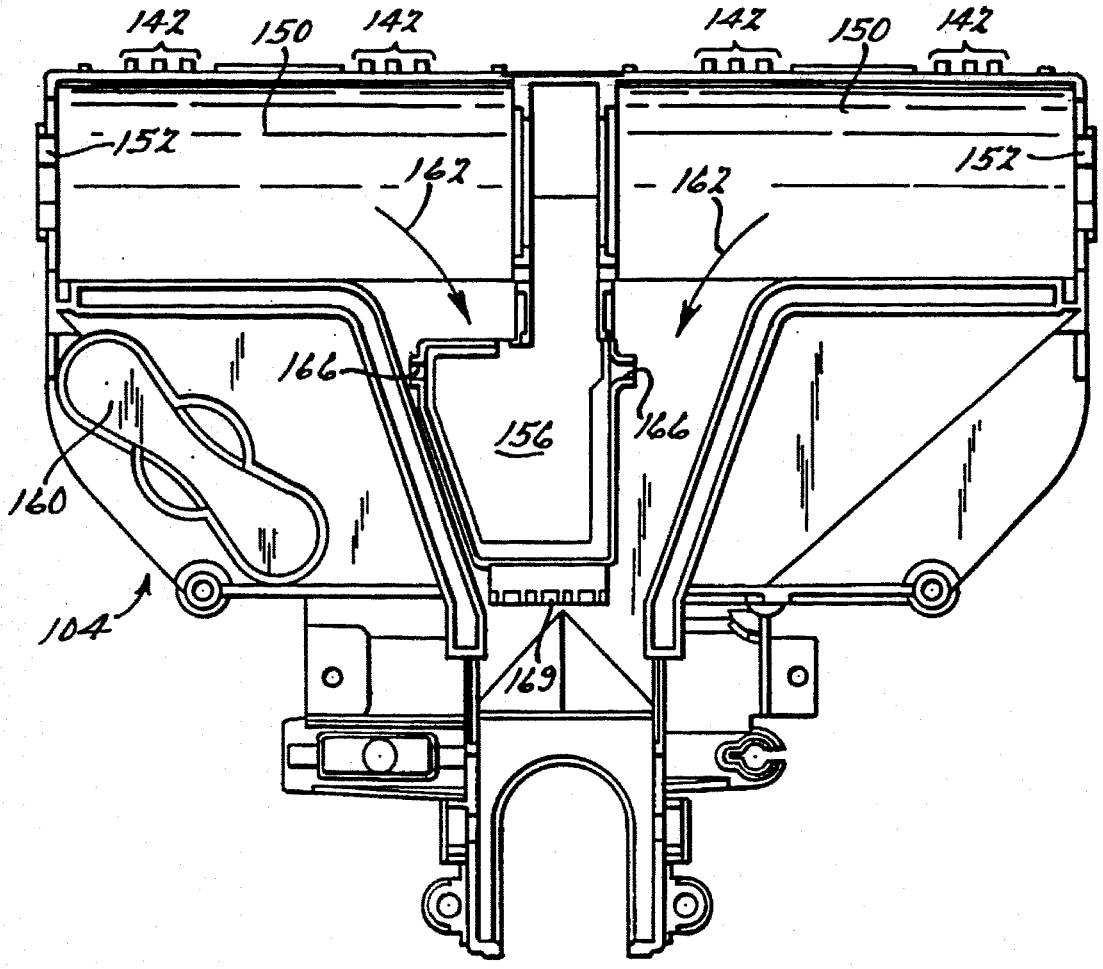
FIG. 9 is a plane view of the bottom surface of the rear sole plate of the cleaning tool of FIG. 5.

Referring now to FIG. 9, the construction of the interior of the upper manifold 104 is shown. The upper manifold 104 includes a pair of semi-cylindrical sections 150 in which the brushroll 110 is disposed. Each cylindrical section 150 includes a semi-circular, notched end portion 152 for supporting each of a pair of hexagonally shaped support members 154 (FIG. 5) of the brushroll 110 (only one being shown in FIG. 5).

With further reference to FIG. 9, a cut-out portion on central area 156 allows room for a drive belt (not shown) to extend from a drive spindle of a motor (not shown) of the cleaning tool 100 to a central drive portion 158 (FIG. 5) of the brushroll 110. A pocket 160 is also integrally formed in the upper manifold 104 to nestably store a spare drive belt. The construction of the manifold 104 forms a "Y-shaped" airflow path, as indicated by airflow arrows 162, which allows an even stronger vacuum airflow to be generated in the area of the semi-circular portions 150, to thereby even further enhance the cleaning efficiency of the cleaning tool 100.

With further reference to FIGS. 5 and 9, the belt cover member 120, when secured to the upper manifold 104, fits within the central area 156 and snappingly engages there via shoulder portions 164 (FIG. 1) on the belt cover 120 within openings 166 (FIG. 9) in the upper manifold 104. A back end 167 of the belt cover member 120 is fixedly secured to the upper manifold 104 at area 169.

Figure 10:
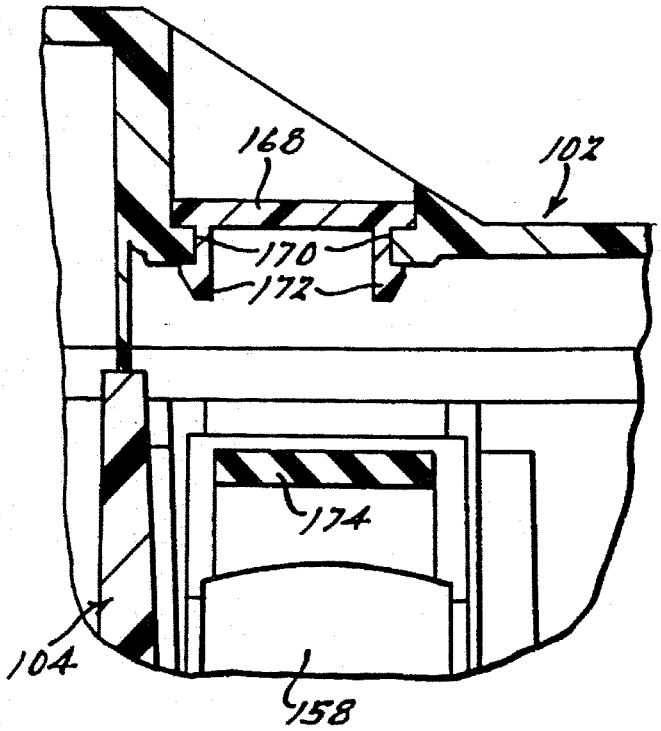
FIG. 10 is a fragmentary, cross-sectional view of the window member secured to the cover of the cleaning tool and a portion of the drive belt of the cleaning tool showing the positioning of the window member substantially directly over the drive belt.

Referring now to FIGS. 5 and 10, the cover 102 (FIG. 5) advantageously includes a clear plastic window 168 for allowing the user to view the drive belt to make a preliminary determination as to whether the drive belt needs replacing. With specific reference to FIG. 10, the window 168 is held snappingly engaged within an aperture 170 in the cover 102 via a plurality (i.e., 3) of latching arm members 172. It will be appreciated that since the window 168 is positioned approximately directly over the drive belt, indicated by reference numeral 174 in FIG. 10, that the condition of the drive belt 174 can be ascertained quickly and easily without having to physically remove the cover 102 or any portion thereof.

With reference now to FIGS. 5 and 11, the brushroll 110 includes a pair of brush stiffening members 176 which are each inserted within grooves 178 formed within a spindle 180 of the brushroll 110. The grooves 178 are complementary in shape to the brush stiffening members 176 to retain the stiffening members 176 therein. The stiffening members 176 are slidably inserted into the grooves 178 prior to installation of the brushroll 110 within the upper manifold 104.

With further specific reference to FIG. 11, each brush stiffening member 176 includes a slot 182 into which an end of a plurality of brush bristles 184 are inserted. The brush stiffening members 176 further each include a raised shoulder portion 186 which helps to provide added rigidity to the brush bristles 184 during rotation. From the drawing of FIG. 11, it will be appreciated that the brush stiffener members 176 have been orientated such that when the spindle member 180 is rotated counter-clockwise, the protruding shoulder portions 186 prevent the brush bristles 184 from being bent over to an excessive degree. The brush stiffener members 176 may be formed from plastic or any other suitably strong material such as by conventional molding techniques.

Figure 12:
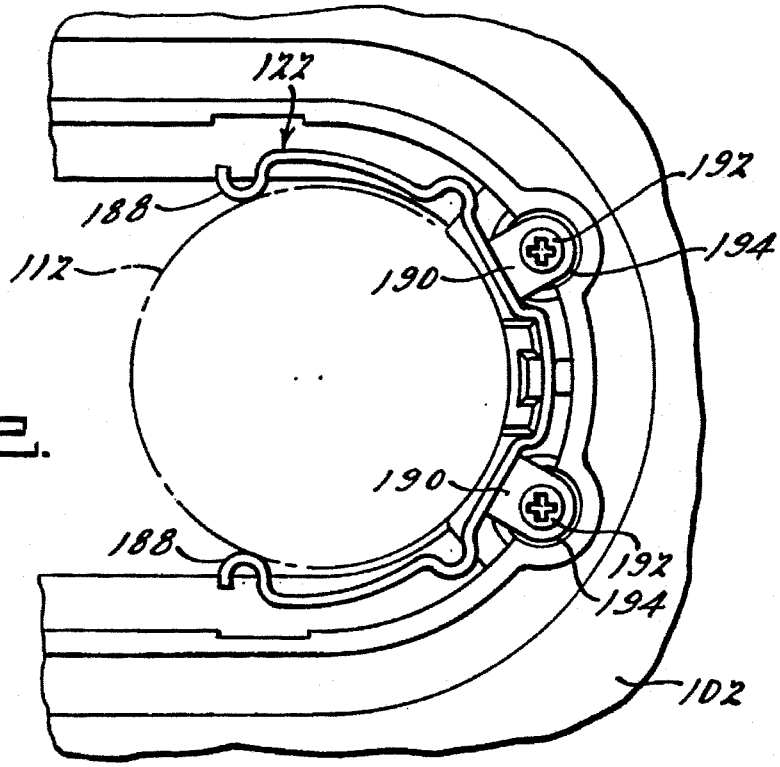
FIG. 12 is a view of the retaining member shown in FIG. 5 of the cleaning tool showing the retaining member assembled to an inside surface of the cleaning tool by a pair of threaded screws.

With specific reference now to FIGS. 5 and 12, the function of the retaining member 122 will be described. The retaining member 122 includes a pair of semi-circular portions 188 and a pair of mounting portions 190. The retaining member 122 is preferably integrally formed from a single piece of metal or plastic which provides a small degree of flexing so as to allow the exhaust tube 112 to be retained therein once the exhaust tube 112 is pivoted into a generally vertical position relative to the cover 102. In this manner the exhaust tube 112, which typically will be secured to a tubular extension wand, will be prevented from falling downwardly when the cleaning tool 100 is not in use and is stored, for example, in a closet. The mounting portions 190 each preferably include an aperture through which a threaded fastener 192 extends into threaded bosses 194 in an interior of the cover 102. Accordingly, the retaining member 112 forms a simple yet effective means for holding the exhaust tube 112 in an upright position when the cleaning tool 100 is not in use.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A cleaning apparatus adapted for use with a vacuum generating device, said cleaning apparatus comprising:

an upper housing having a semi-cylindrical portion adapted to partially house a brushroll therein, said semi-cylindrical portion including a centrally disposed cut-out portion for allowing a drive belt to be coupled to a central portion of said brush roll at the approximate midpoint of the longitudinal length of said brush roll, and a base portion including at least a pair of upper runners for directing airflow to the outermost longitudinal ends of said brushroll;

a lower housing adapted to be secured to said base portion of said upper housing; and a sole plate adapted to be secured under at least said semi-cylindrical portion of said upper housing for defining a plurality of openings through which portions of said brushroll may protrude into contact with a work surface when said apparatus is placed closely adjacent said work surface.

2. The apparatus of claim 1, wherein said base portion of said upper housing includes a cut-out portion for enabling said drive belt to protrude therethrough.

3. The apparatus of claim 1, wherein said lower housing has a cut-out portion for providing a small degree of clearance for said drive belt.

4. The apparatus of claim 1, wherein said openings of said sole plate are on opposite sides of a central portion of said sole plate, said central portion being disposed at approximately a mid-point along a longitudinal length of said brushroll.

5. A cleaning apparatus adapted to be used with a vacuum generating device for cleaning a work surface, said apparatus comprising:

a brushroll;

an upper housing having a base portion and a semi-cylindrical portion, said semi-cylindrical portion being for partially housing said brushroll and including a centrally disposed cut-out portion, said base portion including a pair of upper runners formed therein for directing a vacuum airflow to outermost longitudinal ends of said brushroll;

a lower housing including a pair of lower runners and being securable to said upper housing to form a manifold wherein said upper runners and said lower runners cooperate to define airflow passages to allow a vacuum force from a main vacuum unit to be directed adjacent said outermost longitudinal ends of said brushroll;

a sole plate having a plurality of openings and securable to said lower housing, said plurality of openings allowing portions of said brush to protrude therethrough into close proximity with said work surface, said sole plate including members for partially supporting said brushroll for rotational movement;

a motor for driving said brush; and a belt drive for coupling an output shaft of said motor to said brush, said belt drive extending through said centrally disposed cut-out portion of said upper housing and around a mid-portion of said brushroll such that rotational movement of said output shaft of said motor causes rotational movement of said brushroll.

6. The apparatus of claim 5, wherein said base portion of said upper housing includes a cut-out portion and said lower housing includes a cut-out portion shaped symmetrically with said cut-out portion in said base portion of said upper housing, at least said cut-out portion of said upper housing providing clearance to allow said belt drive to engage said mid-portion of said brush.

7. The apparatus of claim 5, wherein said semi-cylindrical portion of said upper housing includes a pair of outermost longitudinal end portions each having a semi-circular cut-out portion adapted to support a respective end portion of said brush.

8. The apparatus of claim 5, wherein said members of said sole plate each comprise a shoulder portion at each longitudinal end thereof for supporting said brush.

9. The apparatus of claim 5, wherein said upper housing includes a shoulder assembly for enabling a tubular connecting wand coupled to said apparatus to be moved pivotally relative to said apparatus.

10. A cleaning apparatus adapted for use with a vacuum generating device for cleaning a work surface, said apparatus comprising:

an upper housing having a base portion and a semi-cylindrical portion, said semi-cylindrical portion including a centrally disposed cut-out portion and said base portion including a cut-out portion in communication with said centrally disposed cut-out portion to form a single opening;

a lower housing having a cut-out portion and securable to said base portion of said upper housing such that said cut-out portion of said lower housing is aligned with said cut-out portion of said upper housing;

a cylindrical brush partially supported for rotational movement disposed partially within said semi-cylindrical portion of said upper housing;

a motor having an output shaft for rotationally driving said brush;

a drive member for coupling said output shaft of said motor to a longitudinally central portion of said brush, said drive member extending through said centrally disposed cut-out portion in said semi-cylindrical portion and said cut-out portions of said upper and lower housings to thereby enable said brush to be driven rotationally at its approximate longitudinal mid-point; and a front sole plate adapted to be coupled to said lower housing and including a pair of openings for allowing portions of said brush to protrude and having a central portion separating said openings.

11. A cleaning tool apparatus for use with a vacuum generating device, said cleaning tool apparatus comprising:

an upper manifold member having a plurality of semi-cylindrical portions adapted to partially house a brushroll therein, said semi-cylindrical portions being separated by a centrally disposed cut-out portion for allowing a drive belt to be coupled to a drive portion of said brushroll at the approximate midpoint of the longitudinal length of said brushroll;

a rear sole plate for securing to a rear portion of said upper manifold member;

a removable front sole plate adapted to be releasably engaged with said rear sole plate and said upper manifold member such that the front sole plate may be manually removed by a user of said cleaning tool without the need for any external tools.

12. The apparatus of claim 11, wherein said front sole plate includes a front edge portion having a plurality of openings therein;

wherein said manifold includes a front edge portion having a plurality of ridge portions; and said ridge portions extending through said openings in said front edge portion of said front sole plate when said front sole plate is secured to said upper manifold member.

13. The apparatus of claim 12, wherein said front sole plate further includes a plurality of latching arm members;

wherein said rear sole plate includes a plurality of recesses adapted to accept portions of said latching arm members when said front sole plate is releasably secured to said rear sole plate.

14. The apparatus of claim 11, further comprising a cover adapted to be fixedly secured to said upper manifold member;

a pivotal exhaust tube operably coupled with said upper manifold; and a retaining member for releasably retaining said exhaust tube in an upright position during storage of said apparatus, said retaining member being operably associated with said cover.

15. The apparatus of claim 11, further comprising:

a rotatably mounted brushroll disposed partially within said manifold;

a plurality of brush bristles secured to said brushroll; and a brush stiffening member operably associated with said brushroll for providing added rigidity to said brush bristles.

* * * * *